US009247838B2

(12) United States Patent
Kallet

(10) Patent No.: US 9,247,838 B2
(45) Date of Patent: Feb. 2, 2016

(54) COLLAPSIBLE CLOTHES AND ARTICLE HANGER

(71) Applicant: Gregory L. Kallet, Dresher, PA (US)

(72) Inventor: Gregory L. Kallet, Dresher, PA (US)

( * ) Notice: Subject to any disclaimer, the term of this patent is extended or adjusted under 35 U.S.C. 154(b) by 59 days.

(21) Appl. No.: 14/183,574

(22) Filed: Feb. 19, 2014

(65) Prior Publication Data

US 2015/0230644 A1 Aug. 20, 2015

(51) Int. Cl.

| | |
|---|---|
| ***A47G 25/40*** | (2006.01) |
| ***A47F 7/19*** | (2006.01) |
| ***A47G 25/48*** | (2006.01) |

(52) U.S. Cl.

CPC ..... *A47G 25/487* (2013.01); *A47F 7/19* (2013.01); *A47G 25/4023* (2013.01); *A47G 25/4061* (2013.01)

(58) Field of Classification Search

CPC ..... A47G 25/14; A47G 25/28; A47G 25/40; A47G 25/4015; A47G 25/4025; A47G 25/4046; A47G 25/4056; A47G 25/4061; A47G 25/4023; A47F 7/19; A41D 27/22

USPC ..... 223/89, 94; D6/326

See application file for complete search history.

(56) References Cited

U.S. PATENT DOCUMENTS

| | | | | | |
|---|---|---|---|---|---|
| 1,278,054 | A | * | 9/1918 | Strand | 223/89 |
| 1,370,713 | A | * | 3/1921 | Strand | 223/89 |
| 1,448,139 | A | * | 3/1923 | McGinnis | 223/89 |
| 2,232,249 | A | * | 2/1941 | Losin | 24/716 |
| 2,413,221 | A | * | 12/1946 | Elston | 223/89 |
| 2,418,870 | A | * | 4/1947 | Crowder | 223/89 |
| 2,544,170 | A | * | 3/1951 | Mills | 223/89 |
| 2,605,942 | A | * | 8/1952 | Warren et al. | 223/89 |
| 5,397,037 | A | * | 3/1995 | Ozawa | 223/94 |
| 7,185,795 | B1 | | 3/2007 | Wallick | |

* cited by examiner

*Primary Examiner* — Ismael Izaguirre

(74) *Attorney, Agent, or Firm* — Daniel Boudwin; Global Intellectual Property Agency LLC

(57) ABSTRACT

Described is a clothing hanger capable of collapsing into an enclosed unit that is easily stored and is convenient for travel. The hanger comprises a hook and a pair of arms rotatable about the hook and adapted to support the shoulders of a garment. The hanger further comprises a first and second pants bar element that are hingeably connected to one another and which are in hinged connection with the hanger arms. The hanger can be collapsed into an enclosed unit by folding the pants bar elements towards one another and into the hollow undersides of the hanger arms. The hook of the hanger is able to rotate so as to be enclosed by the hanger arms. The hanger further includes an elastic cord that can be removably connected to the arms of the hanger and that is adapted to secure garments in place over the pants bar elements.

13 Claims, 7 Drawing Sheets

COLLAPSIBLE CLOTHES AND ARTICLE HANGER

BACKGROUND OF THE INVENTION

1. Field of the Invention

The present invention relates to clothes and article hangers. More specifically, the present invention pertains to a collapsible clothes hanger that is capable of enclosing its elements within its arms and that allows a user to transport the hanger in a collapsed state between uses.

Tending to clothes that must be placed on a hanger to avoid wrinkling while on the go and while traveling can be a bothersome task. This task becomes particularly bothersome when traveling for an extended period, and where no hanger articles are readily available for supporting clothes while not being worn. Articles of clothing such as jackets, suits, and dress shirts generally require a hanger to properly store the articles in a suspended position, whereby their material does not become creased, bunched, or wrinkled. However, the ability for one to travel with a full-size hanger is limited and rather undesirable, as the hanger consumes space in a travel bag or gym bag and its transport is not efficient.

Several common situations require the use of a clothes hanger while away from home, whereby clothing articles require support between uses. One common situation is when traveling for business, where an individual will generally wear business attire for a portion of the trip and change into casual wear when not actively attending to a business function. While most hotel rooms offer business travelers a means to hang clothing, some provide inadequate hanger types that do not properly support for suits, shirts, and jackets, leaving hanger marks on the clothing. Yet another common situation requiring a hanger article is when visiting the gymnasium after work or before a workday. Many individuals who enjoy exercising during the day are required to wear business attire to their workplace. In order to ensure that the business attire is properly stored when removed at the gym or prior to being donned at the gym in the mornings, a hanger article is essential. Additionally, individuals commonly hang business attire on a hanger in the individual's car while driving to or from work. Again, however, traveling with a full size hanger, or multiple hangers as the case may be, is a bothersome and inefficient prospect.

The present invention describes a new and novel travel hanger device that efficiently collapses into an enclosed unit, whereby the collapsed device can be placed into a travel bag and consume minimal volume therein. The device comprises a first and second hingedly attached arm having an open underside area and an upper surface for supporting the shoulders of an article of clothing. A pair of folding pants bar elements extends from within the interior of the open arms, such that when deployed, the device forms a triangular hanger shape with an upper hook that is also collapsible into the interior of the hanger arms. In this way, the concave or hollow arms close together over the elements of the hanger when collapsed to provide a device that can easily be stowed within luggage when traveling. The hanger of the present invention further comprises an elastic cord that can be removably secured to the arms of the hanger such that the elastic cord is disposed over the pants bar elements. In this way, a user may secure pants or other garments to the pants bar elements by means of the elastic cord.

The ability to travel with a collapsed and enclosed hanger article allows clothing items to be suspended as required between uses, while also consuming as little volume as possible while stowed within the user's luggage. The shape of the collapsed device provides a device with a small cross section and that encloses the elements of the hanger to prevent the hooks or grooves of the hanger from catching or pulling on other items. This improves on most common collapsible hangers in that the article is enclosed within an interior volume, and further improves on the method of carrying a full-size hanger device while traveling.

2. Description of the Prior Art

Devices have been disclosed in the prior art that relate to collapsible hangers for storage and transport purposes. These include devices that have been patented and published in patent application publications, and generally relate to hangers that include hinges for folding or collapsing into a condensed shape. No devices disclose a structure that both supports larger garments while hanging and one that encloses the collapsed elements of the hanger when stowed, as provided by the present invention. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 7,185,795 to Wallick discloses a collapsible hanger device for suspending clothing items therefrom, wherein the device comprises a first, second, and third hanger arm pivotally attached to one another to form a triangular hanger structure that is collapsible into a condensed form. The horizontal hanger arm has two segments that allow it to fold in half, while the other members attach to the ends of the horizontal hanger arm to fold the assembly into an aligned state. The Wallick device is a standard collapsible hanger device that allows its members to fold over one another and align into a single lined formation. The present invention adds to the art of collapsible hangers in that it incorporates a first and second hanger arm forming a widened shoulder support for clothing articles and also forming an enclosure for the elements of the hanger to collapse into when the first and second hanger arm are collapsed and joined together. Further, the present invention is distinguished over Wallick in its disclosure of an elastic cord that can be removably secured to the arms of the hanger and that enables a user to secure garments over the pants bar element of the hanger.

The ability to collapse the hanger structure into an enclosed unit provides several benefits for the user. Among these is the ability to easily stow the compact unit within a luggage article, whereby the device will not snag other items in the luggage and the overall unit will consume very little space therein. Further still, the condensed unit provides a structure that is easy to handle and to carry from one location to another. Finally, the internal components are protected from view such that the device appears as an enclosed structure with a unique and attractive design.

It is submitted that the present invention is substantially divergent in design elements from the prior art, and consequently it is clear that there is a need in the art for an improvement to existing collapsible hanger devices. In this regard the instant invention substantially fulfills these needs.

SUMMARY OF THE INVENTION

In view of the foregoing disadvantages inherent in the known types of collapsible hanger devices now present in the prior art, the present invention provides a new collapsible hanger device that can be utilized for providing convenience for the user when traveling with a clothing hanger without consuming excessive luggage space.

It is therefore an object of the present invention to provide a new and improved collapsible hanger device that has all of the advantages of the prior art and none of the disadvantages.

It is another object of the present invention to provide a collapsible hanger device that can enclose the hanger's elements within its arms such that the hanger can be easily stored and is convenient for travelling.

Another object of the present invention is to provide a collapsible hanger device that is adapted to support an article of clothing without wrinkling the article or creating hanger marks.

Another object of the present invention is to provide a collapsible hanger device having a removable elastic cord that can be secured to the arms of the hanger in order to allow a user to secure pants or other garments to the pants bar of the hanger.

Yet another object of the present invention is to provide a collapsible hanger device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
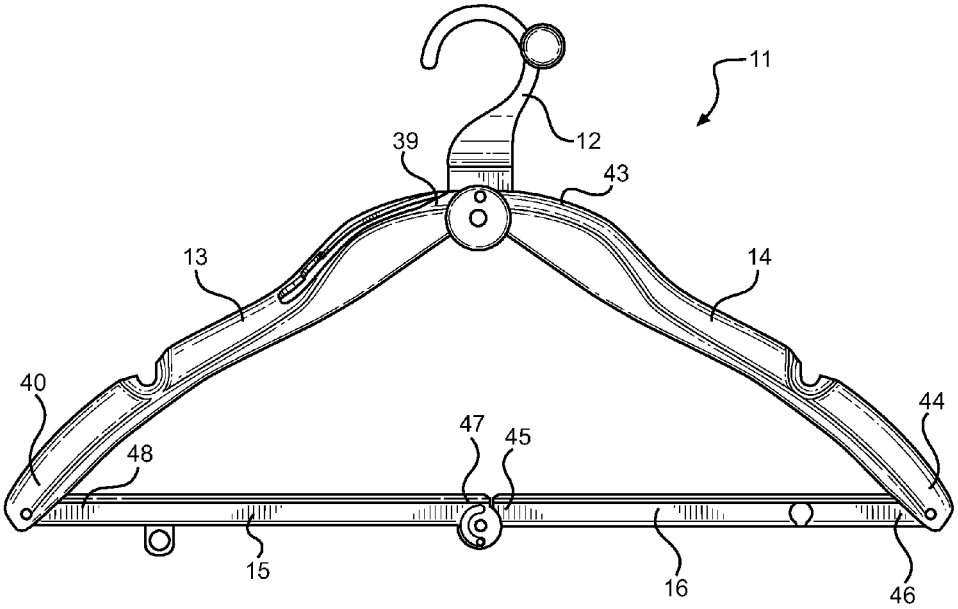
FIG. 1 shows a front view of the preferred embodiment of the present invention in a deployed configuration.

Reference is made herein to the attached drawings. Like reference numerals are used throughout the drawings to depict like or similar elements of the collapsible hanger. For the purposes of presenting a brief and clear description of the present invention, the preferred embodiment will be discussed as used for providing a device for hanging clothes that can be easily transported and stored between uses. The figures are intended for representative purposes only and should not be considered to be limiting in any respect.

Referring now to FIG. 1, there is shown a front view of the preferred embodiment of the present invention in a deployed configuration. The collapsible hanger 11 of the present invention comprises a hook 12 pivotally connected at its lower end to the first end 39 of a first arm 13 and to the first end 43 of a second arm 14 at a common juncture. The arms have upper surfaces that are adapted to support the shoulders of an article of clothing. The arms further have open underside surfaces such that the arms have a hollow interior. The arms are rotatable about the hook 12 such that they can be pivotally rotated towards one another to form a collapsed configuration. The second end 40 of the first arm 13 is hingeably connected to a first end 48 of a first pants bar element 15. Similarly, the second end 44 of the second arm 14 is hingeably connected to a first end 46 of the second pants bar element 16. Finally, the second ends 45, 47 of the first and second pants bar elements 15, 16 are connected to one another at a hinged joint. In this way, when the hanger is in a deployed configuration, the hanger has a triangular configuration similar to a traditional hanger.

The hinged connections allow the hanger to be selectively configured in a first (deployed) configuration in which the hanger is assembled, and a second position in which the hanger is collapsed. In the collapsed configuration, the pants bar elements 15, 16 fold together in a substantially parallel configuration and are enclosed within the hollow undersides of the arms 13, 14 of the hanger. Furthermore, the hook 12 is then rotated so as to also be enclosed within the underside area of the arms 13, 14 of the hanger when collapsed. In this way, all of the components of the hanger are enclosed within the arms of the hanger in the closed configuration and the hanger transforms from a triangular state to an elongated and substantially aligned configuration. Thus, the closed configuration of the hanger provides a device having a small profile so that the hanger can be easily stored when not in use.

Figure 2:
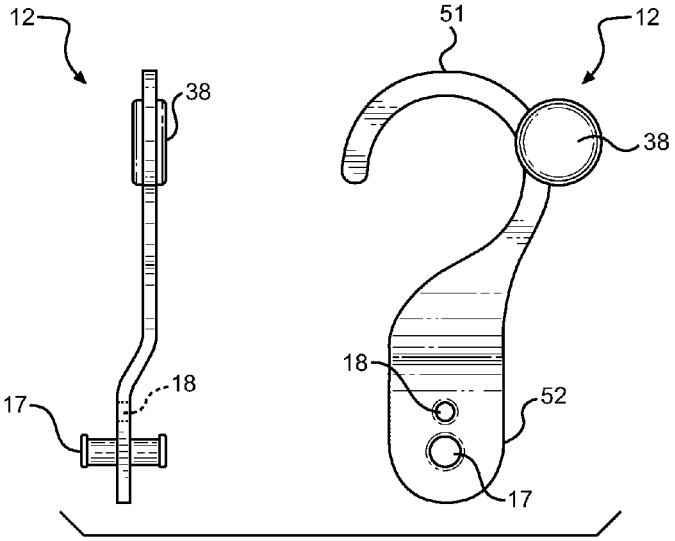
FIG. 2 shows a side and front view of the hook component of the present invention.

Referring now to FIG. 2, there is shown a side view and a front view of the hook 12 component of the present invention. The hook has an upper portion 51 and a lower portion 52. In the embodiment shown, the hook 12 has a curved upper portion 51 similar to traditional hangers, which allows the hook 12 to be placed over a closet rod or a hanging rod. The upper portion further comprises a stopper 38 that is adapted to engage with the cut-out 42 shown in FIG. 3A, such that when the hanger is in the collapsed configuration, the hook is held in position inside of the enclosed portion of the hanger.

Figure 3A:
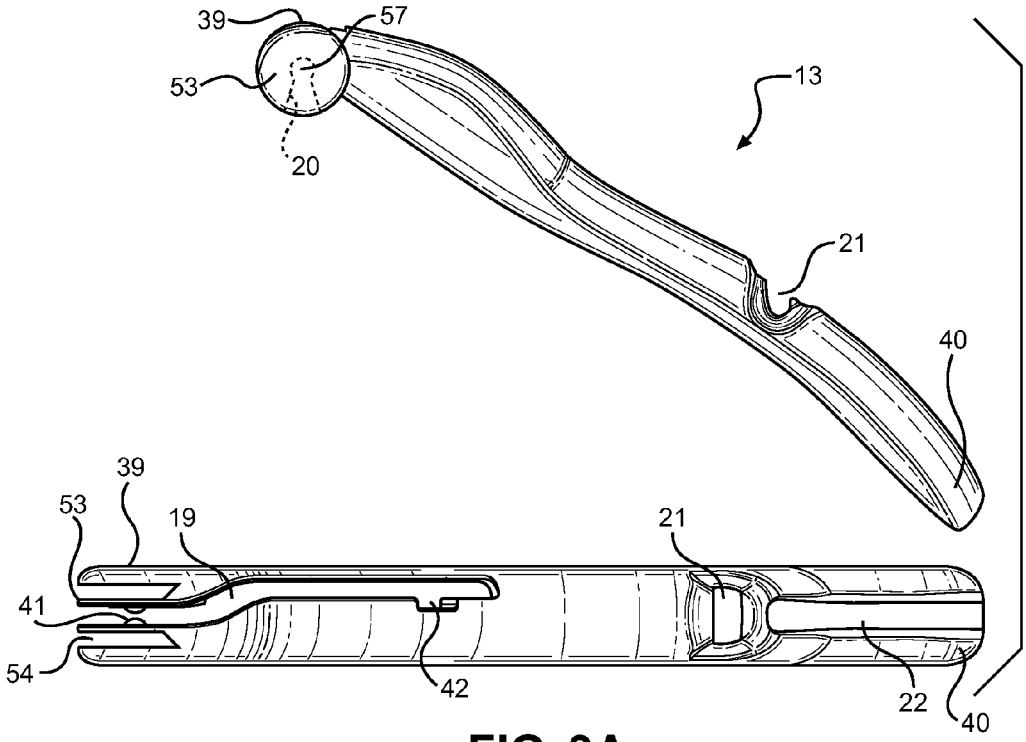
FIG. 3A shows a top and side view of the first arm of the hanger.

The lower portion 52 of the hook 12 includes a pin member 17 that extends outward from the front and back of the hook 12. The pin member 17 is adapted to engage with aligned slot receptacles disposed on clevis arms positioned on both the first and second arms of the hanger so as to form a rotatable connection therewith. In this way, the first and second arms and the hook are able to freely rotate about one another. In the embodiment shown, an aperture 18 is positioned above the pin member 17 and is adapted to receive the protrusions 41 disposed on the first end 39 of the first arm 13 of the hanger as shown in FIG. 3A. The engagement of the protrusions 41 with aperture 18 serves to releasably lock the hanger in the deployed configuration. In this way, the hanger is secured in a deployed configuration until the user wishes to collapse the hanger, and the hanger is prevented from rearranging itself into the collapsed configuration due to the weight of an article of clothing suspended thereon.

Referring now to FIG. 3A, there are shown top and side views of the first arm of the hanger of the present invention. A first arm 13 has a first end 39 and a second end 40, wherein the first end 39 comprises one or more clevis arms 53 each having a slot receptacle 20. Each slot receptacle 20 comprises an area that is cut-out of the clevis arm 53 that tapers towards a circular central region 57. The shape of the slot receptacles 20 allows the pin member 17 of the hook 12 to slide into the slot receptacle and secured in the circular central region 50. The connection of the pin member 17 with the circular central region 50 of the slot receptacle 20 creates a hinged connection allowing the first arm 13 to rotate about the pin member 17 of the hook 12.

Figure 4:
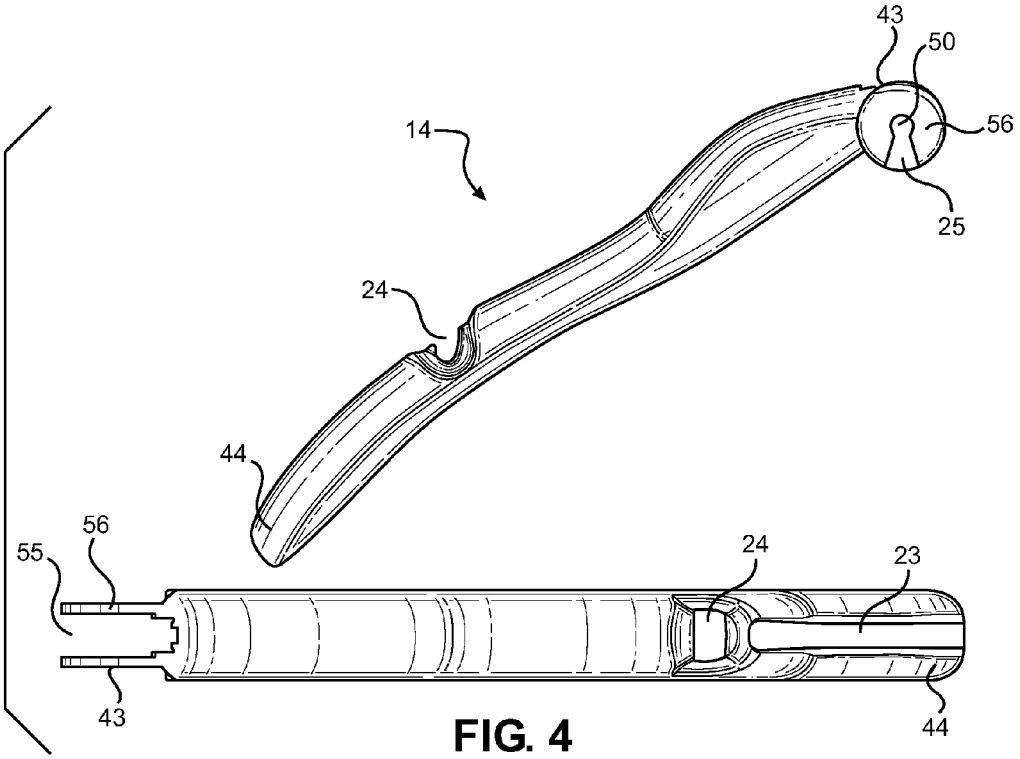
FIG. 4 shows a top and side view of the second arm of the hanger.

The one or more clevis arms 53 on the first arm 13 are separated by spaces 54. The clevis arms 53 are separated so as to allow the clevis arms of the second arm of the hanger to mate with the clevis arms of the first arm. The spaces 54 are positioned such that the clevis arms 56 of the second arm 14 as shown in FIG. 4 can be positioned within said spaces 54. In this way, both the first arm 13 and the second arm 14 are able to mate with one another, and engage with the pin member 17 on the hook 12. Accordingly, the hook 12, the first arm 13, and the second arm 14 are capable of rotating about the connection of the pin member 17 and the clevis arms 53, 56.

The first arm 13 further includes a slot 19 extending from said first end 39 towards said second end 40 that is adapted to allow the hook 12 to pass through. The first arm 13 further comprises a groove 21 disposed on its upper surface. The groove is adapted to receive the straps of an article of clothing such as a dress or blouse, such that the straps can be held securely in place on the arms of the hanger. Additionally, the groove is adapted to receive an anchor of the elastic cord of the present invention. An anchor of the elastic cord can be positioned in the groove 21 and the cord extends along an elongated channel 22 extending from the groove 21 towards the second end 40 of said first arm 13. The channel 22 consists of a concave depression in the upper surface of the first arm extending along the arm length. The depression helps to keep the elastic cord in position on the upper surface of the first arm of the hanger.

Figure 3B:
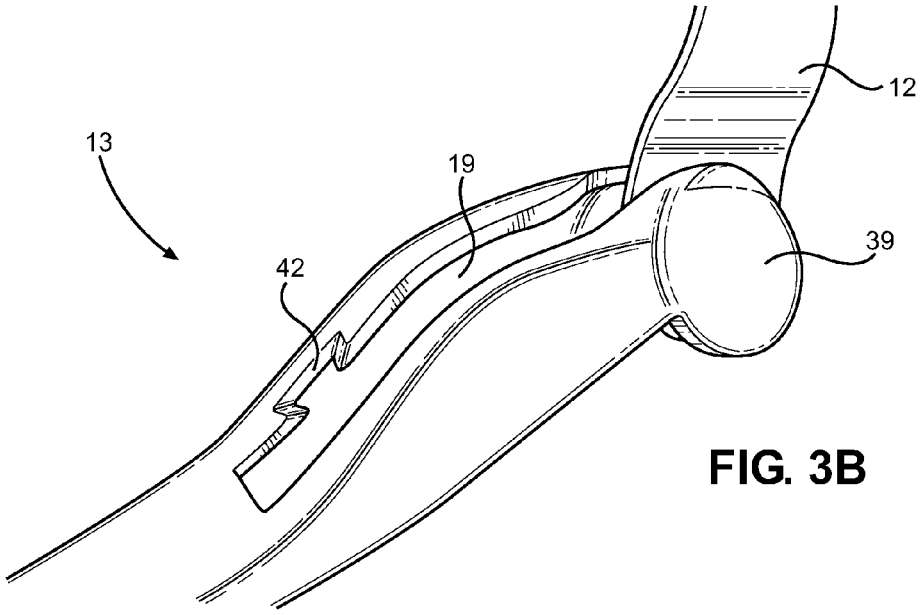
FIG. 3B shows a perspective view of the slot on the first arm of the hanger.

Referring now to FIG. 3B, there is shown a perspective view of the slot on the first arm of the hanger. In the collapsed configuration of the hanger, the hook 12 can be rotated so that the hook can be positioned within the underside of the hanger. Thus, slot 19 is shaped so as to allow the hook to pass through the first arm and into the enclosed region of the collapsed hanger. The slot 19 further comprises a cut-out 42 adapted to engage with the stopper 38 on the hook shown in FIG. 2. Thus, when the hanger is in a collapsed configuration, the hook is rotated through the slot 19 and the stopper 38 catches on the cut-out 42, holding the hook 12 in place, and preventing the hook from further rotating into the enclosed portion of the hanger.

Referring now to FIG. 4, there are shown top and side views of the second arm of the hanger of the present invention. The second arm 14 has a first end 43 and a second end 44, wherein the first end 43 has one or more clevis arms 56 each having a slot receptacle 25. The slot receptacles 25 on the second arm 14 are shaped in the same way as the slot receptacles 20 on the first arm 13. Thus, the slot receptacles 25 comprise an area cut into the clevis arm 53 that tapers towards a circular center region 50. The pin member 17 can be inserted into the slot receptacle 25 of the second arm 14 and be securely held within the circular center region 50. Further, the clevis arms 56 on the second arm 14 are adapted to mate with the clevis arms 53 of the first arm 13, such that the pin member 17 of the hook 12 can engage with both the first and second arm of the hanger. The clevis arms 56 of the second arm 14 are separated by a space 55 that is adapted to allow the hook 12 and clevis arms 53 of the first arm 13 of the hanger to be positioned therein. Similar to the first arm of the hanger, the second arm 14 includes a groove 24 disposed on the upper surface of the second arm 14 adapted to receive the strap of an article of clothing, and further adapted to receive an anchor of the elastic cord. The second arm also has an elongated channel 23 on the upper surface of the second arm in which the elastic cord can extend. The channel 23 extends along the length of the arm from the groove 24 towards the second end 44 thereof.

Figure 5:
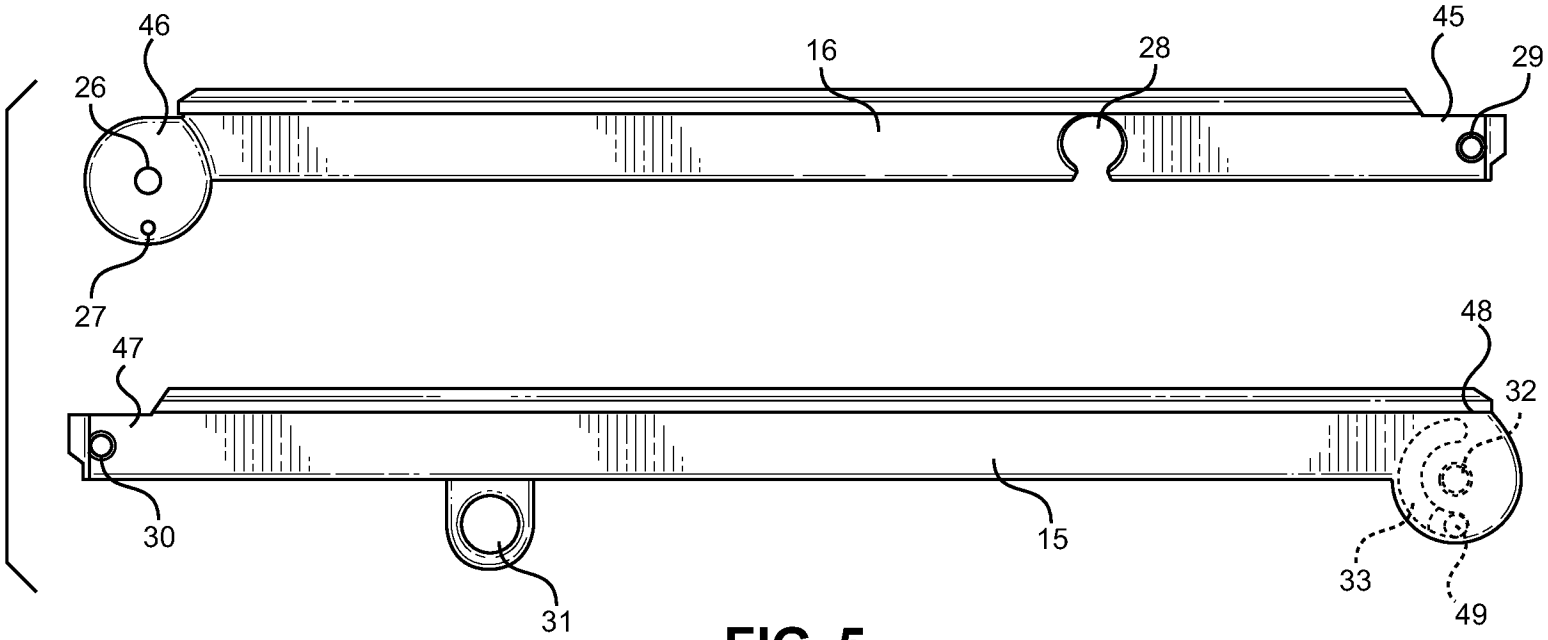
FIG. 5 shows a side view of the first and second pants bar elements.

Referring now to FIG. 5, there is shown a side view of the first and second pants bar elements. A first pants bar element 15 is elongated and has a first end 47 and second end 48. The first end 47 has an aperture 30 that is adapted to receive a protrusion positioned on the underside of the first arm of the hanger so as to form a hinged connection therewith. This connection allows the first arm and the first pants bar element to rotate about the connection. Similarly, the second pants bar element 16 has a first end 45 and a second end 46. The first end 45 of the second pants bar element comprises an aperture 29 that is adapted to engage with a pin or protrusion positioned on the underside of the second arm of the hanger. This establishes a hinged connection between the second arm of the hanger and the second pants bar element.

A locking member 31 extends downward from the first pants bar element 15 and is adapted to engage with a locking aperture 28 on the second pants bar element 16. When the hanger is positioned in a collapsed configuration, the locking member 31 engages with the locking aperture 28 on the second pants bar element so that the first and second pants bar elements are releasably secured together. In this way, the hanger is able to remain in the collapsed configuration until the user wishes to reconfigure the hanger into the assembled configuration.

The second end 48 of the first pants bar element 15 is hingeably connected to the second end 46 of the second pants bar element. The hinged connection is formed by the engagement of an indentation 32 on the first pants bar element with a knob 26 of the second pants bar element. A secured and rotatable connection is established between the knob 26 and indentation 32. Further, a channel 33 is positioned on the second end of the first pants bar element and is adapted to receive a sliding pin 27 disposed on the second end of the second pants bar element. The channel 33 comprises a semi-circular shape and constrains the ability of the first and second pants bar elements to rotate about the hinged connection. The sliding pin 27 can move slidably within the channel 33 so as to allow the hanger to be selectively rearranged into the collapsed or assembled configuration. In this way, the pants bar elements can only be rotated so as to form the assembled or collapsed configuration. The pants bar elements can only be folded into the interior of the hanger arms. The channel may further comprise a terminal indentation 49 at one or both ends of the channel 33 such that when the sliding pin is positioned at an end of the channel, the terminal indentation releasably secures the sliding pin within the terminal indentation so as to help maintain the hanger in either an assembled or collapsed configuration.

Figure 6B:
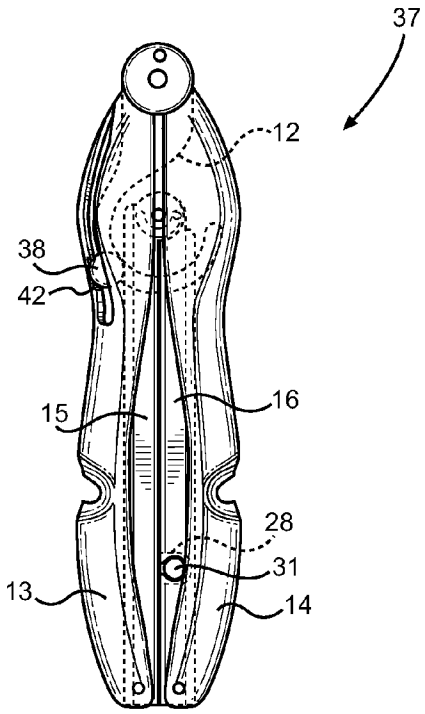
FIG. 6B shows an embodiment of the hanger of the present invention in a fully collapsed configuration.
Figure 6A:
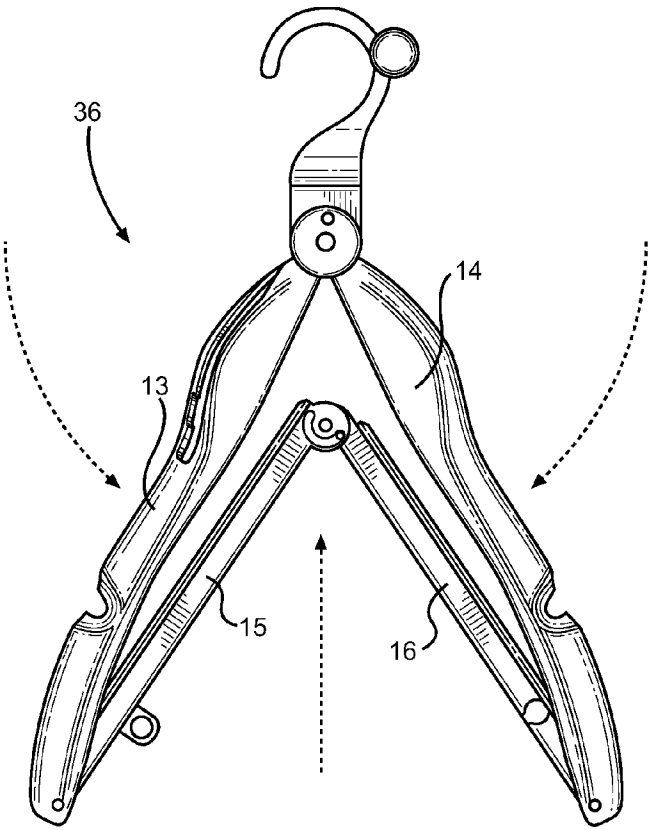
FIG. 6A shows an embodiment of the hanger of the present invention in a partially collapsed configuration.

Referring now to FIGS. 6A and 6B, there is shown a partially collapsed, and a fully collapsed view of the hanger of the present invention. In the partially collapsed configuration 36, the first arm 13 and second arm 14 of the hanger arm folded inward, and towards one another. Additionally, the first pants bar element 15 and second pants bar element 16 are folded upwards so as to be enclosed by the hollow underside of the arms of the hanger. In the fully collapsed configuration 37, the first arm 13 and second arm 14 of the hanger are folded together. The first and second pants bar elements 15, 16 are folded together so as to be touching, and are enclosed in the hollow underside of the arms of the hanger. The hook 12 is rotated such that it is also enclosed by the arms of the hanger. The stopper 38 on the hook 12 engages with the cut-out 42 on the first arm 13 of the hanger, which holds the hook in place and prevents it from moving further into the enclosed region of the collapsed hanger. Further, the locking member 31 on the first pants bar element 15 engages with the aperture 28 on the second pants bar element 16, and secures the pants bar elements together in the collapsed configuration. In this way, the collapsed hanger has a small profile with the pants bar elements and hook enclosed within the hollow undersides of the arms of the hanger.

Figure 7:
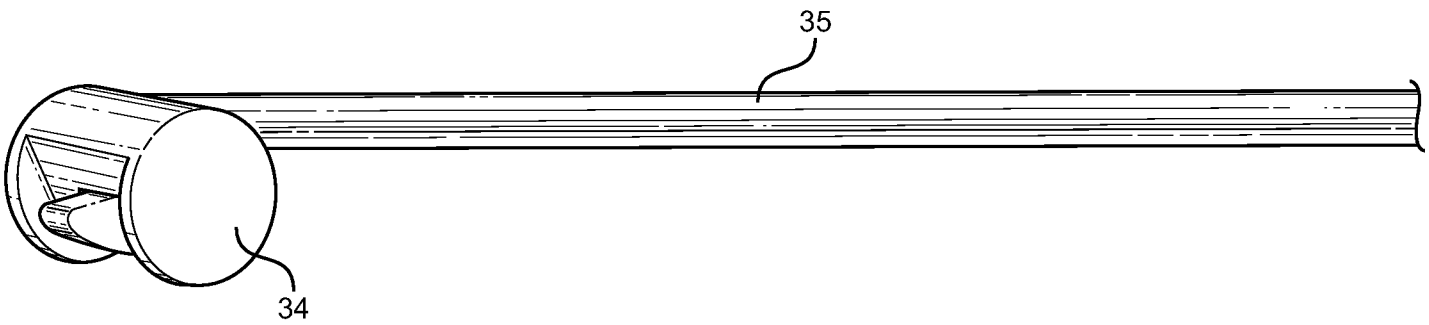
FIG. 7 shows a view of the elastic cord of the present invention.
Figure 8:
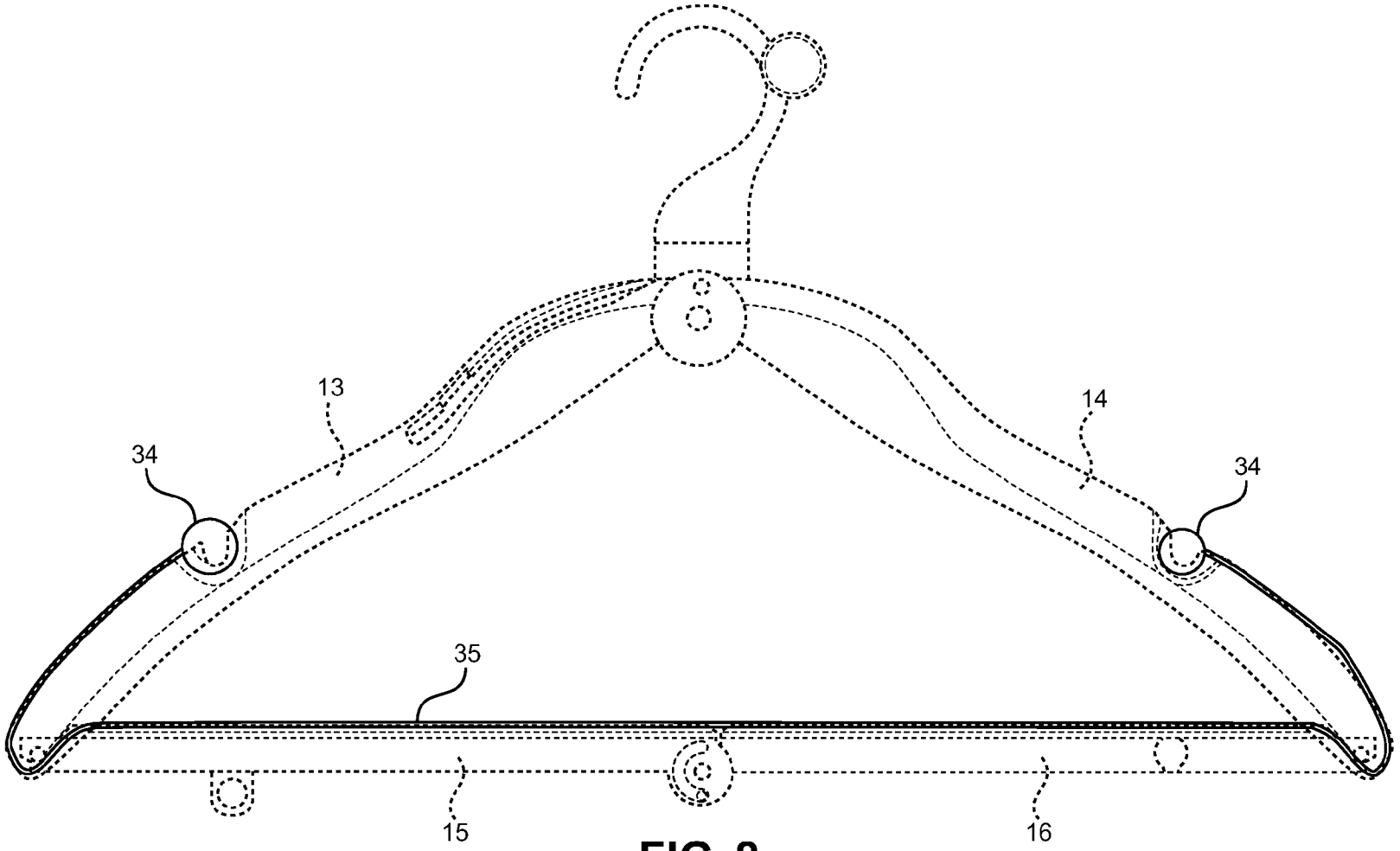
FIG. 8 shows a view of how the elastic cord attaches to the hanger of the present invention.

Referring now to FIGS. 7 and 8, there is shown a perspective view of the elastic cord of the present invention. The elastic cord comprises an elastic band 35 having a first and a second end. An anchor 34 is positioned at the first end of the elastic band, and a second anchor is positioned at the second end of the elastic band. The anchors 34 are adapted to engage with the grooves on the first arm 13 and second arm 14 of the hanger. When the anchors 34 are placed in the grooves on the first and second arms, garment straps may still be hung in the notch formed between the anchor and the arm itself. Thus, the functionality of the groove as a place in which clothing straps may be positioned is maintained when the anchors of the elastic cords are disposed therein. With the anchors secured in the grooves, the elastic band stretches between the two anchors. The elastic band extends along the channels on the first arm 13 and second arm 14, wraps around the second ends of the first and second arms, and extends across an upper surface of the first and second pants bar elements 15, 16. Pants or other articles of clothing can be placed between the pants bar elements and the elastic cord. In this way, the elastic cord can hold the pants or other articles in place without making marks or creases on the pants that would result from the use of a clip or similar pants holding device.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible clothes hanger, comprising:

a hook, a first arm, a second arm, a first pants bar element, and a second pants bar element;

said first arm having a first end, a second end, an upper surface, and an open underside, wherein said first end of said first arm is connected to and rotatable about said hook;

said second arm having a first end, a second end, an upper surface, and an open underside, wherein said first end of said second arm is connected to and rotatable about said hook;

said first pants bar element having a first end and a second end, wherein said first end of said first pants bar element is connected to and rotatable about said second end of said first arm;

said second pants bar element having a first end and a second end, wherein said first end of said second pants bar element is connected to and rotatable about said second end of said second arm;

wherein said second end of said first pants bar element and said second end of said second pants bar element are connected to and rotatable about one another; and wherein said first arm and said second arm are adapted to rotate towards one another and enclose said first pants bar element and said second pants bar element, so as to selectively arrange the hanger in a collapsed configuration or a deployed configuration;

said first end of said first arm comprises one or more clevis arms and wherein said first end of said second arm comprises one or more clevis arms;

said clevis arms on said first arm being adapted to mate with said clevis arms of said second arm, and wherein each clevis arm has an aligned slot receptacle adapted to engage with a pin member on said hook such that said first arm and second arm are able to rotate about said pin member.

2. The hanger of claim 1, wherein said upper surface of said first arm further comprises a slot shaped such that said hook is capable of passing through said slot when rotated.

3. The hanger of claim 1, wherein:

said upper surface of said first arm further comprises a slot shaped such that said hook is capable of passing through said slot when rotated;

said hook further comprises a stopper disposed on an upper end of said hook, and wherein said slot further comprises a cut-out adapted to engage with said stopper when said hook is rotated such that engagement of said stopper with said cut-out secures said hook in position.

4. The hanger of claim 1, wherein said first arm and said second arm each further comprise:

a groove on said upper surface thereof;

a channel on said upper surface thereof extending from said groove toward said second end of said arm;

an elastic cord having a first and a second end, wherein a first anchor is disposed at said first end and a second anchor is disposed at said second end;

said first anchor and said second anchor being adapted to engage said grooves on said upper surfaces of said first arm and said second arm; and said elastic cord adapted to be accepted into said channel of said first arm and said second arm and extend along an upper surface of said first and second pants bar element.

5. The hanger of claim 1, wherein said hook further comprises an aperture adapted to engage with one or more protrusions disposed on said first arm so as to releasably lock the hanger in a deployed configuration when said aperture is engaged with said one or more protrusions of said first arm.

6. The hanger of claim 1, wherein said first pants bar element comprises a locking member adapted to engage with a locking aperture on said second pants bar element, so as to releasably lock the hanger in a collapsed configuration.

7. The hanger of claim 1, wherein said first and second pants bar element are rotatable about one another by means of an indentation on said first pants bar element that is adapted to receive a knob on said second pants bar element wherein engagement of said indentation and said knob results in a hinged connection.

8. The hanger of claim 1, wherein said first pants bar element further comprises a channel adapted to receive a sliding pin on said second pants bar element that is adapted to slide within said channel, wherein the engagement of said sliding pin within said channel serves to constrain the rotation of said first and second pants bar element.

9. The hanger of claim 8, wherein said channel comprises a first and second end, wherein a terminal indentation is disposed at said first and said second end, so as to releasably secure said sliding pin within said terminal indentation to prevent further sliding of said sliding pin within said channel.

10. A collapsible clothes hanger, comprising:

a hook, a first arm, a second arm, a first pants bar element, and a second pants bar element;

said first arm having a first end, a second end, an upper surface, and an open underside, wherein said first end of said first arm is connected to and rotatable about said hook;

said second arm having a first end, a second end, an upper surface, and an open underside, wherein said first end of said second arm is connected to and rotatable about said hook;

said first pants bar element having a first end and a second end, wherein said first end of said first pants bar element is connected to and rotatable about said second end of said first arm;

said second pants bar element having a first end and a second end, wherein said first end of said second pants bar element is connected to and rotatable about said second end of said second arm;

wherein said second end of said first pants bar element and said second end of said second pants bar element are connected to and rotatable about one another; and wherein said first arm and said second arm are adapted to rotate towards one another and enclose said first pants bar element and said second pants bar element, so as to selectively arrange the hanger in a collapsed configuration or a deployed configuration; and said upper surface of said first arm further comprises a slot shaped such that said hook is capable of passing through said slot when rotated;

said hook further comprises a stopper disposed on an upper end of said hook, and wherein said slot further comprises a cut-out adapted to engage with said stopper when said hook is rotated such that engagement of said stopper with said cut-out secures said hook in position.

11. A collapsible clothes hanger, comprising:

a hook, a first arm, a second arm, a first pants bar element, and a second pants bar element;

said first arm having a first end, a second end, an upper surface, and an open underside, wherein said first end of said first arm is connected to and rotatable about said hook;

said second arm having a first end, a second end, an upper surface, and an open underside, wherein said first end of said second arm is connected to and rotatable about said hook;

said first pants bar element having a first end and a second end, wherein said first end of said first pants bar element is connected to and rotatable about said second end of said first arm;

said second pants bar element having a first end and a second end, wherein said first end of said second pants bar element is connected to and rotatable about said second end of said second arm;

wherein said second end of said first pants bar element and said second end of said second pants bar element are connected to and rotatable about one another; and wherein said first arm and said second arm are adapted to rotate towards one another and enclose said first pants bar element and said second pants bar element, so as to selectively arrange the hanger in a collapsed configuration or a deployed configuration;

a groove on said upper surface thereof;

a channel on said upper surface thereof extending from said groove toward said second end of said arm;

an elastic cord having a first and a second end, wherein a first anchor is disposed at said first end and a second anchor is disposed at said second end;

said first anchor and said second anchor being adapted to engage said grooves on said upper surfaces of said first arm and said second arm; and said elastic cord adapted to be accepted into said channel of said first arm and said second arm and extend along an upper surface of said first and second pants bar element.

12. A collapsible clothes hanger, comprising:

a hook, a first arm, a second arm, a first pants bar element, and a second pants bar element;

said first arm having a first end, a second end, an upper surface, and an open underside, wherein said first end of said first arm is connected to and rotatable about said hook;

said second arm having a first end, a second end, an upper surface, and an open underside, wherein said first end of said second arm is connected to and rotatable about said hook;

said first pants bar element having a first end and a second end, wherein said first end of said first pants bar element is connected to and rotatable about said second end of said first arm;

said second pants bar element having a first end and a second end, wherein said first end of said second pants bar element is connected to and rotatable about said second end of said second arm;

wherein said second end of said first pants bar element and said second end of said second pants bar element are connected to and rotatable about one another; and wherein said first arm and said second arm are adapted to rotate towards one another and enclose said first pants bar element and said second pants bar element, so as to selectively arrange the hanger in a collapsed configuration or a deployed configuration; and wherein said hook further comprises an aperture adapted to engage with one or more protrusions disposed on said first arm so as to releasably lock the hanger in a deployed configuration when said aperture is engaged with said one or more protrusions of said first arm.

13. A collapsible clothes hanger, comprising:

a hook, a first arm, a second arm, a first pants bar element, and a second pants bar element;

said first arm having a first end, a second end, an upper surface, and an open underside, wherein said first end of said first arm is connected to and rotatable about said hook;

said second arm having a first end, a second end, an upper surface, and an open underside, wherein said first end of said second arm is connected to and rotatable about said hook;

said first pants bar element having a first end and a second end, wherein said first end of said first pants bar element is connected to and rotatable about said second end of said first arm;

said second pants bar element having a first end and a second end, wherein said first end of said second pants bar element is connected to and rotatable about said second end of said second arm;

wherein said second end of said first pants bar element and said second end of said second pants bar element are connected to and rotatable about one another; and wherein said first arm and said second arm are adapted to rotate towards one another and enclose said first pants bar element and said second pants bar element, so as to selectively arrange the hanger in a collapsed configuration or a deployed configuration; and wherein said first and second pants bar element are rotatable about one another by means of an indentation on said first pants bar element that is adapted to receive a knob on said second pants bar element wherein engagement of said indentation and said knob results in a hinged connection.

* * * * *